US008967755B2

(12) United States Patent
Kikura et al.

(10) Patent No.: US 8,967,755 B2
(45) Date of Patent: Mar. 3, 2015

(54) IMAGE FORMING APPARATUS

(71) Applicants: Makoto Kikura, Kanagawa (JP); Kazuyoshi Matsumoto, Tokyo (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP)

(72) Inventors: Makoto Kikura, Kanagawa (JP); Kazuyoshi Matsumoto, Tokyo (JP); Kazuyoshi Kondo, Tokyo (JP); Yuuzoh Obata, Tokyo (JP); Norikazu Yanase, Kanagawa (JP); Yoshinori Uchino, Kanagawa (JP); Gaku Hosono, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/950,473

(22) Filed: Jul. 25, 2013

(65) Prior Publication Data

US 2014/0028752 A1 Jan. 30, 2014

(30) Foreign Application Priority Data

Jul. 27, 2012 (JP) ..... 2012-167775

(51) Int. Cl.

| | |
|---|---|
| ***B41J 29/38*** | (2006.01) |
| ***B41J 2/01*** | (2006.01) |
| ***B41J 13/00*** | (2006.01) |
| ***B41J 3/407*** | (2006.01) |
| ***B41J 11/42*** | (2006.01) |
| *B41J 11/70* | (2006.01) |

(52) U.S. Cl.

CPC ..... *B41J 13/0009* (2013.01); *B41J 3/4075* (2013.01); *B41J 11/42* (2013.01); *B41J 29/38* (2013.01); *B41J 11/703* (2013.01)

USPC ..... 347/16; 347/101; 347/104; 347/105

(58) Field of Classification Search

USPC ..... 347/16, 101, 104–105

See application file for complete search history.

(56) References Cited

U.S. PATENT DOCUMENTS

| | | | | |
|---|---|---|---|---|
| 6,293,669 | B1 * | 9/2001 | Uchida | 347/104 |
| 6,634,640 | B1 | 10/2003 | Yoshizawa et al. | |
| 2007/0252886 | A1 * | 11/2007 | Sambongi et al. | 347/171 |
| 2008/0316279 | A1 | 12/2008 | Takemoto et al. | |
| 2011/0273511 | A1 | 11/2011 | Yanase et al. | |
| 2011/0279499 | A1 | 11/2011 | Kemma et al. | |
| 2012/0206552 | A1 | 8/2012 | Uchino | |
| 2012/0293583 | A1 | 11/2012 | Kemma et al. | |
| 2012/0320127 | A1 | 12/2012 | Kikura et al. | |
| 2013/0003121 | A1 | 1/2013 | Matsumoto et al. | |
| 2013/0113861 | A1 | 5/2013 | Kikura et al. | |
| 2013/0113862 | A1 | 5/2013 | Kemma et al. | |

FOREIGN PATENT DOCUMENTS

| | | |
|---|---|---|
| JP | 8-073102 | 3/1996 |
| JP | 2001-058754 | 3/2001 |
| JP | 2002-080161 | 3/2002 |
| JP | 2002-284131 | 10/2002 |
| JP | 2003-146318 | 5/2003 |
| JP | 2004-059310 | 2/2004 |

* cited by examiner

*Primary Examiner* — Jason Uhlenhake

(74) *Attorney, Agent, or Firm* — Cooper & Dunham LLP

(57) ABSTRACT

An image forming apparatus includes an apparatus body, a print medium, a conveyance unit, art image forming unit, a cutter unit, a holding unit, a sensor, and a controller. The print medium has an adhesive face with no separation sheet. The cutter unit cuts the medium having an image formed into a print medium piece. The holding unit is configured to hold the piece in a state in which the piece is drawable from outside of the body. The holding unit has a surface separatable from an adhesive face of the piece to hold the adhesive face of the piece. The sensor detects presence or absence of the piece held by the holding unit. After the sensor detects that the piece is drawn out, the controller controls the conveyance unit to convey the medium to the holding unit and controls the holding unit to hold the medium.

14 Claims, 10 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2012-167775, filed on Jul. 27, 2012, in the Japan Patent Office, the entire disclosure of which is hereby incorporated by reference herein.

BACKGROUND

1. Technical Field

This disclosure relates to an image forming apparatus and an image forming method, and more specifically to an image forming apparatus and method of forming an image on a print medium having an adhesive face.

2. Description of the Related Art

Image forming apparatuses are used as printers, facsimile machines, copiers, plotters, or multi-functional devices having, e.g., two or more of the foregoing capabilities. As one type of image forming apparatuses, for example, an image forming apparatus, such as a label printer, is known that prints a print medium having an adhesive face with no separation sheet mounted thereon, such as a label sheet having no tape or mount sheet, (hereinafter, also referred to as "linerless label sheet") and cuts the print medium to a desired length after printing to form a print medium piece (hereinafter, "label piece").

For such an image forming apparatus, an adhesive face of the label piece is exposed after cutting. As a result, the label piece may be adhered to another label piece or an operator's hand or cloth, thus resulting in a reduced adhesion or an unavailable defective label.

Hence, a stacker apparatus like that described in JP-2003-146318-A is proposed for adhesive labels having no mounts. The adhesive label has a separation-processed print portion on the front face side and an adhesive portion on the back face side. The stacker apparatus includes a cutter section for cutting the adhesive label into label pieces, a conveyance section to convey the label pieces cut by the cutter section, a cylindrical rotary member rotatably disposed at a downstream side of the conveyance section to rotate while temporality adhering the label pieces discharged from a conveyance means to an outer surface of the rotary member, and a biasing means to urge the label pieces discharged from the conveyance section, from the front face side toward the rotary member.

Alternatively, another stacker device like that described in JP-2004-059310-A is proposed for adhesive labels having no mounts. The stacker device includes a conveyance means for conveying and discharging a label piece cut at a cutter portion and a label receiving stand portion having a disk-like rotation member that is placed rotatably and substantially in a horizontal state on a downstream side of the conveyance means and that rotates while making the label piece discharged from the conveyance means temporarily stick on its non-adhesive processed surface.

However, for such a configuration described in JP-2003-146318-A or JP-2004-059310-A, label pieces discharged are (temporarily) adhered to a rotary (rotation) member and stacked on the rotary member. The inventors have recognized that such a configuration results in an increased size of the apparatus. In addition, since label pieces are once adhered to another member (rotary member), the adhesive force of label pieces is reduced.

BRIEF SUMMARY

In at least one exemplary embodiment of this disclosure, there is provided an image forming apparatus including an apparatus body, a print medium, a conveyance unit, an image forming unit, a cutter unit, a holding unit, a sensor, and a controller. The print medium is installed to the apparatus body. The print medium has an adhesive face with no separation sheet mounted on the adhesive face. The conveyance unit conveys the print medium. The image forming unit forms an image on the print medium conveyed by the conveyance unit. The cutter unit cuts the print medium having the image formed thereon into a print medium piece of a desired length. The holding unit is disposed downstream from the cutter unit in a conveyance direction in which the print medium is conveyed. The holding unit is configured to hold the print medium piece in a state in which the print medium piece is drawable from outside of the apparatus body. The holding unit has a surface separatable from an adhesive face of the print medium piece to hold the adhesive face of the print medium piece. The sensor detects presence or absence of the print medium piece held by the holding unit. After the sensor detects that the print medium piece held by the holding unit is drawn out, the controller controls the conveyance unit to convey the print medium to the holding unit and controls the holding unit to hold the print medium.

In at least one exemplary embodiment of this disclosure, there is provided an image forming apparatus including an apparatus body, a print medium, conveyance means, image forming means, cutting means, holding means, detection means, and control means. The print medium is installed in the apparatus body. The print medium has an adhesive face with no separation sheet mounted on the adhesive face. The conveyance means conveys the print medium. The image forming means forms an image on the print medium conveyed by the conveyance means. The cutting means cuts the print medium having the image formed thereon into a print medium piece of a desired length. The holding means holds the print medium piece in a state in which the print medium piece is drawable from outside of the apparatus body. The detection means detects presence or absence of the print medium piece held by the holding means. After the detection means detects that the print medium piece held by the holding means is drawn out, the control means controls the conveyance means to convey the print medium to the holding means and control the holding means to hold the print medium.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
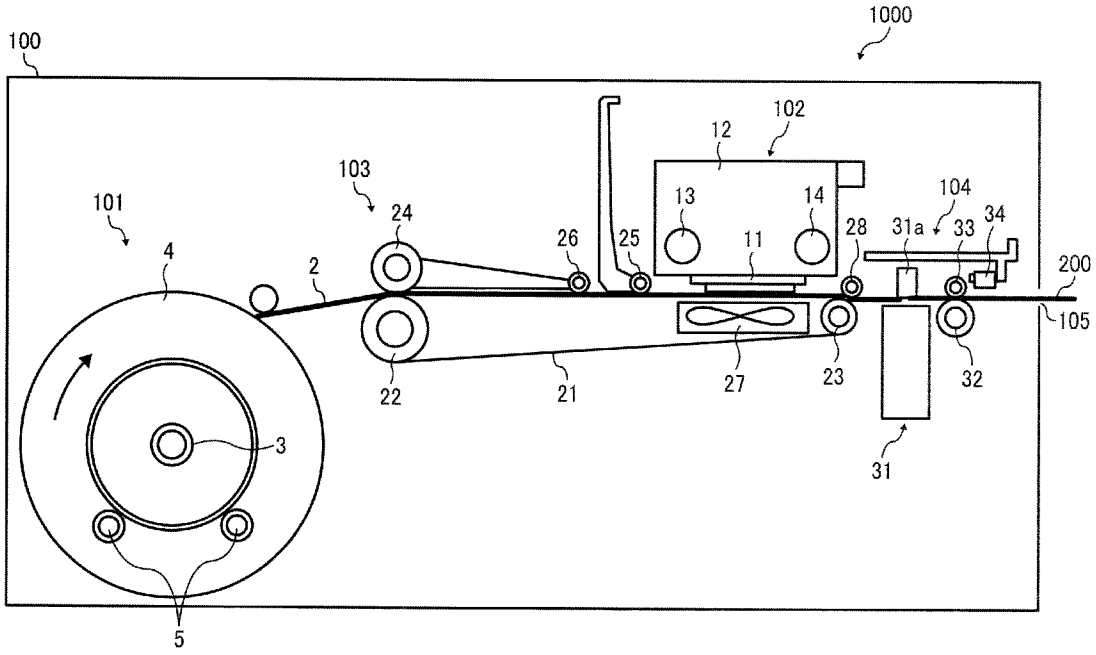
FIG. 1 is a side view of a configuration of an image forming apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

The term "image formation" used herein includes providing not only meaningful images, such as characters and figures, but meaningless images, such as patterns, to print media (in other words, the term "image formation" also includes causing liquid droplets to land on print media).

The term "ink" is not limited to "ink" in a narrow sense, unless specified, but is used as a generic term for any types of liquid usable as targets of image formation. For example, the term "ink" includes recording liquid, fixing solution, liquid, and so on.

The term "image forming apparatus", unless specified, also includes both serial-type image forming apparatus and line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to a first exemplary embodiment of this disclosure is described with reference to FIGS. 1 to 5.

Figure 2:
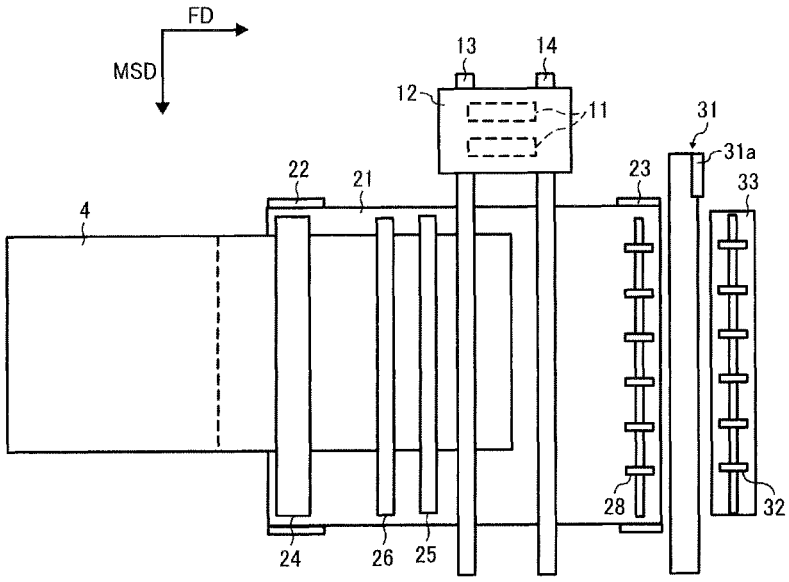
FIG. 2 is a plan view of the image forming apparatus of FIG. 1.
Figure 3A:
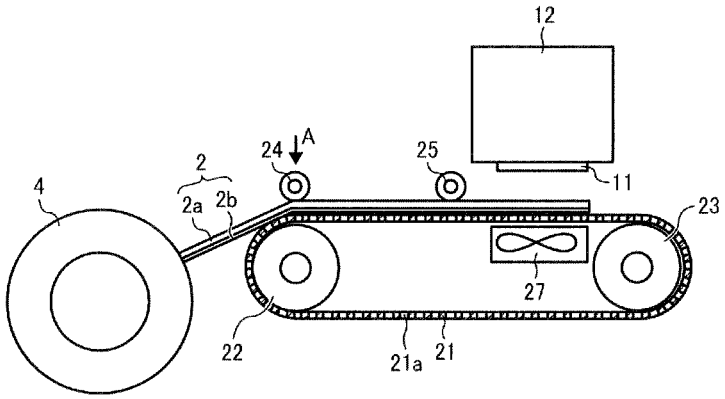
FIGS. 3A and 3B are side views of a portion of the image forming apparatus of FIG.
Figure 3B:
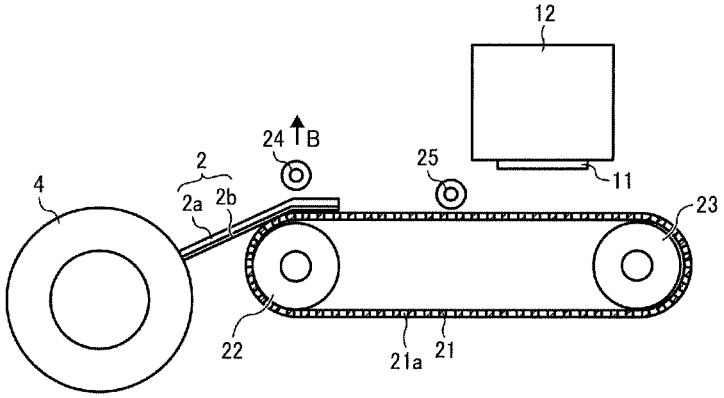
Figure 4:
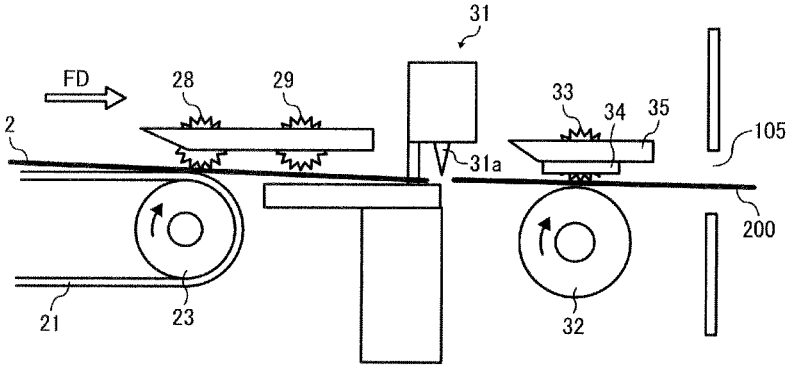
FIG. 4 is a side view of an output unit of the image forming apparatus of FIG. 1.
Figure 5:
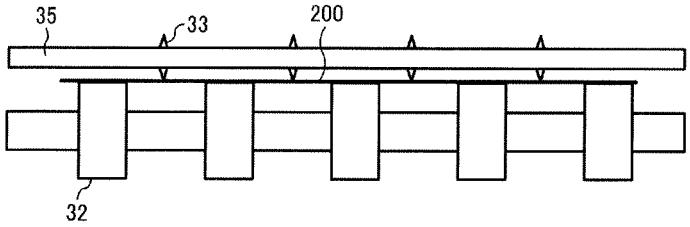
FIG. 5 is a front view of the output unit of FIG. 4.

FIG. 1 is a side view of an entire configuration of an image forming apparatus 1000 according to a first exemplary embodiment of this disclosure. FIG. 2 is a plan view of the image forming apparatus 1000 of FIG. 1. FIGS. 3A and 3B are simplified side views of the image forming apparatus 1000 of FIG. 1. FIG. 4 is a side view of an output unit of the image forming apparatus 1000 of FIG. 1. FIG. 5 is a front view of the output unit of FIG. 4.

As illustrated in FIG. 1, the image forming apparatus 1000 has a feed unit 101 as feeding means, an image forming unit 102 as image forming means, a conveyance unit 103 as conveyance means, and an output unit 104 as output means within an apparatus body 100.

The feed unit 101 has a core member 3 and a media roll 4 formed of a print medium 2 rolled around the core member 3. The media roll 4 is rotatably supported by media-roll support members 5.

As illustrated in FIGS. 3A and 3B, the print medium 2 is a continuum having an image-formable medium (hereinafter, "print face") 2*a* and an adhesive layer (hereinafter, referred to as "adhesive face") 2*b* formed on a surface of the image-formable medium 2*a*. The print medium 2 is rolled around the core member 3 in a state in which a mount sheet (separation sheet or separator) is not adhered to the adhesive face 2*b*.

The image forming unit 102 includes at least one recording head 11 and a carriage 12. The recording head 11 is a Liquid ejection head mounted on the carriage 12 to eject liquid droplets onto the print medium 2. The carriage 12 is supported by guide members 13 and 14 so as to be reciprocally movable along a direction perpendicular to a feed direction of the print medium 2 indicated by an arrow FD in FIG. 2.

In this exemplary embodiment, the recording head 11 has, for example, two nozzle rows. The image forming unit 102 has two recording heads 11 having four nozzle rows to eject ink droplets of, for example, black (K), cyan (C), magenta (M), and yellow (Y). It is to be noted that the configuration of the recording head is not limited to the above-described configuration but may be, for example, a line-type recording head.

The image forming unit 102 is not limited to the above-described type of liquid ejection head but may be any other type of image forming unit to form images in a contact or non-contact manner.

The conveyance unit 103 includes a protection belt 21 as a protection member to protect the adhesive face of the print medium 2. The protection belt 21 is arranged in an endless belt form below the recording heads 11. In other words, the protection belt 21 is looped around a conveyance roller 22 serving as a rotor and a driven roller 23 so as to be movable for circulation.

A first pressing roller 24 is disposed opposing the conveyance roller 22. A rotor pair (in this exemplary embodiment, a roller pair) of the conveyance roller 22 and the first pressing roller 24 forms a conveyance unit serving as conveyance means to convey the print medium 2 to an image forming region of the recording heads 11 by sandwiching the print medium 2 and the protection belt 21 together.

Such a configuration prevents a non-conveyable state due to adherence of the adhesive face 2*b* to a conveyance passage to convey a print medium or an unstable conveyance due to an increased resistance against conveyance of a print medium.

The protection belt 21 includes multiple holes 21*a*. Within a loop formed by the protection belt 21, a suction fan 27 is disposed opposing the recording heads 11 of the image forming unit 102. The suction fan 27 sucks the print medium 2 toward a surface of the protection belt 21 via the holes 21*a*. In the above-described configuration, the print medium 2 is adhered onto the protection belt 21 by suction. It is to be noted that the force to adhere the print medium to the protection belt is not limited to suction but, for example, electrostatic force is used to adhere the print medium onto the protection belt.

A second pressing roller 25 is disposed downstream from the conveyance roller 22 and upstream from the image forming region of the recording heads 11 in the feed direction FD of the print medium 2 to press the print medium 2 against the protection belt 21. An intermediate pressing roller 26 is disposed between the first pressing roller 24 and the second pressing roller 25. Spur rollers 28 are disposed opposing the driven roller 23.

The output unit 104 has a cutter unit 31 as cutting means at a position downward from the recording heads 11 in the feed section of the print medium 2. The cutter unit 31 includes a cutter 31*a* to cut the print medium 2 to a desired length to form a print medium piece (label piece) 200. The cutter unit 31 cuts the print medium 2 by moving the cutter 31*a* along a main scanning direction indicated by an arrow MSD in FIG. 2.

Spur rollers 29 are disposed downstream from the driven roller 23 in the feed direction FD of the print medium 2 to press the print medium 2 when the cutter unit 31 cuts the print medium 2. In some embodiments, a pressing roller is disposed below the spur rollers 29 to sandwich the print medium 2 by the pressing roller and the spur rollers 29 to more stably press the print medium 2 during cutting of the print medium 2. In such a configuration, the pressing roller is non-adhesive processed.

Output rollers 32 are disposed downstream from the cutter unit 31 in the feed direction FD of the print medium 2. Spur rollers 33 are disposed opposite the output rollers 32 across the print medium 2 fed from the driven roller 23 and the spur rollers 28. The output rollers 32 and the spur rollers 33 form an output unit or means also serving as a holding unit or means to feed the label piece 200 formed by cutting of the cutter unit 31 to an output port 105 and hold the label piece 200.

In this exemplary embodiment, surfaces of the output rollers 32 to hold the label piece 200 are, for example, non-adhesive processed so that an adhesive face 2*b* of the label piece 200 is separatable from the surfaces of the output rollers 32. The non-adhesive process is a process for preventing the adhesive face 2*b* from adhering to the surfaces of the output rollers 32. In some embodiments, the output rollers 32 include a material facilitating separation from the adhesive face 2*b*.

As illustrated in FIG. 5, the output rollers 32 are disposed at desired spaces in the main scanning direction MSD of FIG. 2. The spur rollers 33 held by a roller holder 35 are disposed between the output rollers 32.

Such a configuration in which the output rollers 32 do not directly oppose the spur rollers 33 prevents the adhesive face 2*b* from being directly pressed against the output rollers 32. In addition, such a configuration reduces adhesion of the adhesive face 2*b* to the output rollers 32 and resistance force in drawing the print medium piece 200 from the output port 105.

The output unit 104 has a sensor 34 serving as detection means to detect at the positions of the output rollers 32 whether the label piece 200 having been cut from the print medium 2 passes. In some embodiments, the sensor 34 optically senses the label piece 200 by detecting, e.g., a reflection light. In some embodiments, the sensor 34 directly senses passing of the label piece 200 by a feeler.

For the image forming apparatus having such a configuration, when an image is formed on the print medium 2, the print medium 2 is drawn from the media roll 4 installed to the feed unit 101. Meanwhile, the first pressing roller 24 is retracted to a position away from the conveyance roller 22 as indicated by an arrow B in FIG. 3B.

The print medium 2 is passed through a nipping portion between the conveyance roller 22 and the first pressing roller 24, and the first pressing roller 24 is moved in a direction to press the print medium 2 and the protection belt 21 against the conveyance roller 22 as indicated by an arrow A in FIG. 3A. As a result, the print medium 2 and the protection belt 21 are sandwiched together between and by the conveyance roller 22 and the first pressing roller 24.

When the conveyance roller 22 is rotated, as illustrated in FIG. 3A, the print medium 2 is conveyed with the adhesive face 2*b* protected by the protection belt 21, and a desired image is formed on the print medium 2 by the recording heads 11 of the image forming unit 102.

When the protection belt 21 is separated form the print medium 2 having the image formed, the print medium 2 is conveyed to the output unit 104 and cut at a desired position by the cutter unit 31 to form a print medium piece. The print medium piece is held between the output rollers 32 and the spur rollers 33 serving as the holding unit in a state in which the print medium piece is drawable out from the output port 105 of the apparatus body 100.

Next, an outline of a controller of an image forming apparatus according to at least one exemplary embodiment of this disclosure is described with reference to FIG. 6

Figure 6:
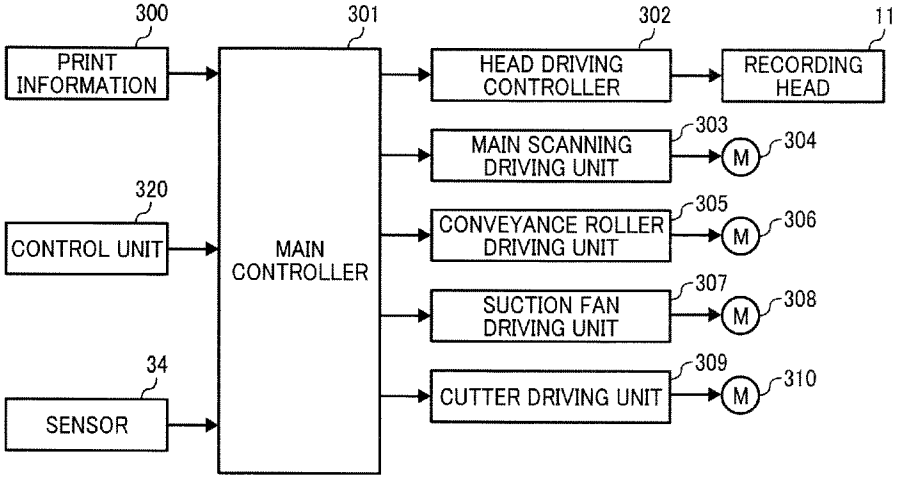
FIG. 6 is a block diagram of a controller of the image forming apparatus of FIG. 1.

FIG. 6 is a block diagram of a controller of an image forming apparatus according to at least one exemplary embodiment of this disclosure.

The controller includes, e.g., a main controller 301 serving as control means, a head driving controller 302, a main-scanning driving unit 303, a conveyance-roller driving unit 305, a suction-fan driving unit 307, a cutter driving unit 309.

The main controller 301 is, e.g., a central processing unit (CPU), a read-only memory (ROM), a random access memory (RAM), a micro computer, such as an input and output (I/O) unit, a volatile random access memory (VRAM), and an application specific integrated circuit (AMC).

Print information 300 is input from a host to the main controller 301.

To form an image on the print medium 2 in accordance with the print information 300, the main controller 301 controls driving of a conveyance motor 306 via the conveyance-roller driving unit 305 to rotate the conveyance roller 22 to intermittently convey the print medium 2 while drawing the print medium 2 from the media roll 4. The main controller 301 also controls driving of a main-scanning motor 304 via the main-scanning driving unit 303 to move the carriage 12 for scanning in the main scanning direction. Meanwhile, the main controller 301 controls driving of the recording heads 11 via the head driving controller 302 to eject liquid droplets from the recording heads 11.

When the conveyance roller 22 is rotated to convey the print medium 2, the main controller 301 controls driving of a suction fan motor 308 via the suction-fan driving unit 307 to rotate the suction fan 27 to adhere the print medium 2 onto the protection belt 21.

When the conveyance motor 306 is rotated and a drive of the conveyance roller 22 is transmitted to the output rollers 32, the output rollers 32 are rotated.

The main controller 301 drives a cutter motor 310 to move the cutter 31*a* of the cutter unit 31 in the main scanning direction via the cutter driving unit 309 to cut, to a desired length, the print medium 2 having the image formed by the recording heads 11 to create a print medium piece (label piece).

A control panel (control unit) 320 is connected to the main controller 301. Detection signals (sensing signals) of the sensor 34 are input to the main controller 301.

Next, control of printing operation by the controller according to at least one exemplary embodiment of this disclosure is described with reference to FIG. 7.

Figure 7:
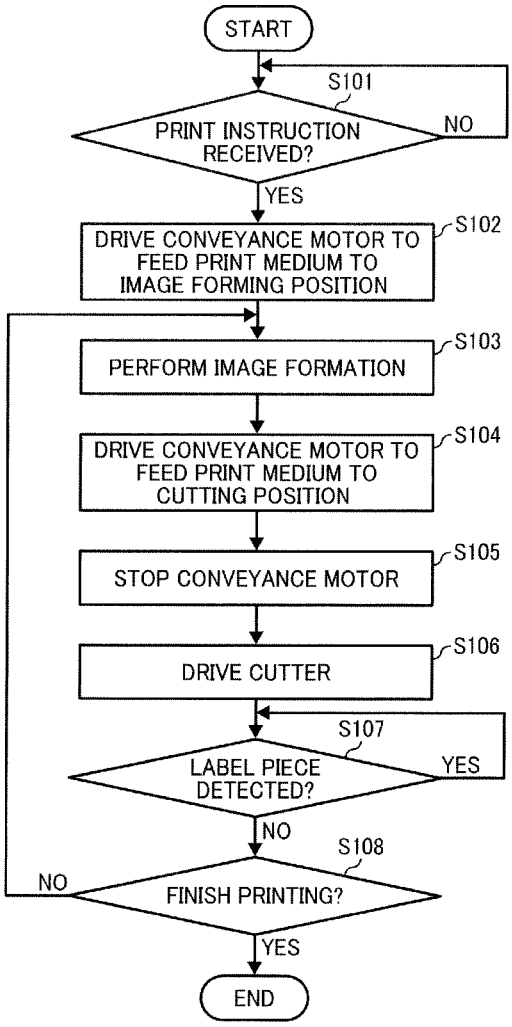
FIG. 7 is a flowchart of a procedure of printing control performed by the controller.

FIG. 7 is a flowchart of a procedure of control of printing operation by the controller according to at least one exemplary embodiment of this disclosure.

On receiving a print instruction at S101, at S102 the main controller 301 drives the conveyance motor 306 via the conveyance-roller driving unit 305 to rotate the conveyance roller 22 to convey the print medium 2 to an image formation position. As described above, in the steps, the output rollers 32 are rotated while the conveyance roller 22 is rotated.

At 103, image forming operation including driving of the recording heads 11, moving of the carriage 12, and intermittent conveyance of the print medium 2 is performed to form a desired image on the print medium 2.

At S104, the main controller 301 drives (or continues driving) the conveyance motor 306 to convey a cut position of the print medium 2 having the image formed to a cutting position of the cutter unit 31 and at S105 stops the conveyance motor 306. As a result, the output rollers 32 are stopped.

At S106, the main controller 301 moves the cutter 31*a* of the cutter unit 31 in the main scanning direction and cuts the print medium 2 to form a label piece 200.

At this time, the label piece 200 is sandwiched and held by the output rollers 32 and the spur rollers 33 in a state in which the label piece 200 is drawable out from the output port (extraction port) 105.

At S107, the main controller 301 determines whether or not the label piece 200 is detected by the sensor 34 (i.e., the label piece 200 is present or not).

When the sensor 34 does not detect the label piece 200 (NO at S107), at S108 the main controller 301 determines whether or not printing operation is finished. When printing operation is not finished (NO at S108), the process returns to S103 and restarts image forming operation. When printing operation is finished (YES at S108), the process ends.

In other words, after the print medium 2 is cut into a print medium piece, i.e., the label piece 200, the label piece 200 is held in a state in which the label piece 200 is drawable out from the output port 105 of the label piece 200. After the label piece 200 is drawn out from the output port 105 by an operator, the main controller 301 starts the next image forming operation.

As described above, holding the label piece 200 in such a drawable state prevents the adhesive face 2*b* of the label piece 200 from adhering to other members and enhances ease of handling of label piece after cutting without reducing the adhesive force.

The surfaces of the output rollers 32 are processed to facilitate separation from the adhesive face 2*b* of the label piece 200, thus preventing adherence of the label piece 200 to the output rollers 32 and facilitating drawing of the label piece 200. In addition, the processed surfaces of the output rollers 32 prevents the output rollers 32 from taking a portion of adhesive material out of the adhesive face 2*b* of the label piece 200, thus preventing a reduction in the adhesive force of the label piece 200.

Here, first and second comparative examples are described with reference to FIGS. 8A and 8B.

Figure 8A:
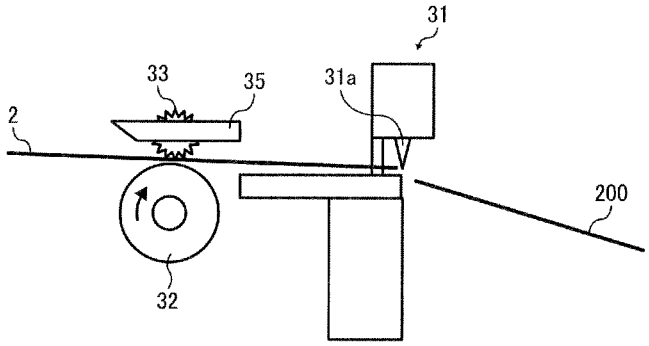
FIG. 8A is a side view of an output unit according to a comparative example 1.
Figure 8B:
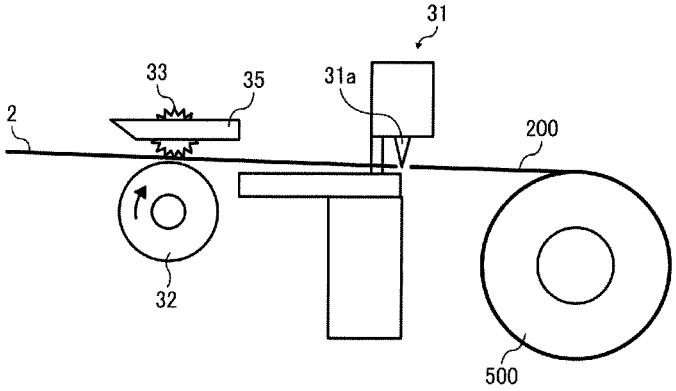
FIG. 8B is a side view of an output unit according to a comparative example 2.

FIG. 8A is a schematic view of an output unit according to the first comparative example. FIG. 8B is a schematic view of an output unit according to the second comparative example.

For the first comparative example, a cutter unit 31 is disposed downstream from output rollers 32 in a feed direction of a print medium 2. When an operator draws the print medium 2 output by the output rollers 32 as a label piece 200, the operator handles the cutter unit 31 to cut the print medium 2.

For such a configuration, the label piece 200 having been cut from the print medium 2 is not held, drops immediately after cutting, and adheres to other components, thus resulting in a reduced adhesive force or other failure.

For the second comparative example, as with the first comparative example, a cutter unit 31 is disposed downward from output rollers 32, and a reel roll 500 is disposed downward from the cutter unit 31 to reel a label piece 200.

For such a configuration, since the label piece 200 having been cut by the cutter unit 31 is reeled and stocked by the reel roll 500, the label piece 200 may also be curled even after separation from the reel roll 500. In addition, since an adhesive face of the label piece 200 is once adhered onto the reel roll 500, the adhesive force may be reduced.

By contrast, for the above-described configuration, as described above, the label piece 200 is held at the output port in a state in which the label piece 200 is drawable from the output port, thus preventing dropping of the label piece 200 and a failure due to reeling of the label piece 200 to the reel roll 500.

For the above-described exemplary embodiment, the next image forming operation is started after the label piece 200 is drawn out from the output port 105. In some embodiments, when the distance from an image forming unit 102 to a cutting position of a cutter unit 31 is longer than a length of a label piece 200, the next image formation is performed and a conveyance unit stands by. After the label piece 200 is drawn out, the conveyance unit conveys a print medium 2 to the cutting position.

In such a case, a driving system of a conveyance roller 22 is separately provided from a driving system of output rollers 32 so that the conveyance roller 22 can be driven independent of the output rollers 32.

In other words, after a detector (e.g., a sensor 34) detects that a label piece 200 held by a holding unit (e.g., output rollers 32 and spur rollers 33) is drawn out, a main controller 301 controls the conveyance unit 103 to convey a print medium 2 to a cutting position of the cutter unit 31. When the distance from an end position of image formation to the cutting portion is longer than a length of the label piece 200, image formation is performed in advance. By contrast, when the distance is shorter than the length of the label piece 200, image formation is started after the label pieces 200 is drawn out.

Next, a second exemplary embodiment of this disclosure is described with reference to FIG. 9.

Figure 9:
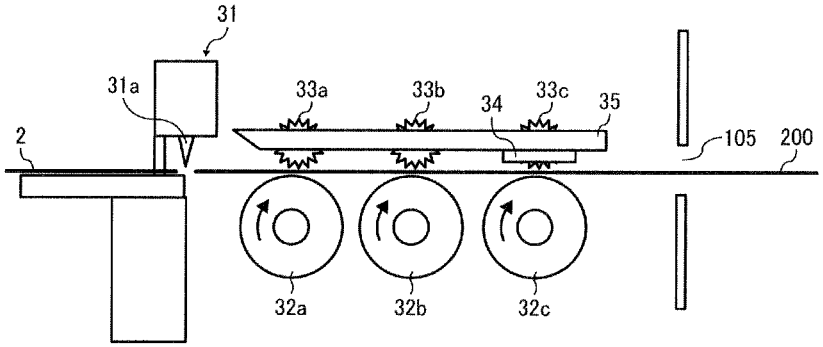
FIG. 9 is a side view of an output unit according to a second exemplary embodiment of this disclosure.

FIG. 9 is a side view of an output unit of an image forming apparatus according to the second exemplary embodiment of this disclosure.

In this exemplary embodiment, multiple rotors forming an output unit (in FIG. 9, multiple sets of output rollers 32*a* to 32*c*) are disposed downward from a cutter unit 31 in a feed direction of a print medium 2. Multiple sets of spur rollers 33*a* to 33*c* and the sets of output rollers 32*a* to 32*c* are disposed at opposite sides across a label piece 200 cut from the recording medium 2. A sensor 34 is disposed to detect the label piece 200 at a position corresponding to the output rollers 32*c*, which are located at a most downstream side of the sets of output rollers 32*a* to 32*c* in the feed direction of the print medium 2. Driving force of the conveyance roller 22 is transmitted to the sets of output rollers 32*a* to 32*c* to rotate the sets of output rollers 32*a* to 32*c*. In other words, in this disclosure, rollers rotated by receiving a rotation driving force are referred to as "output rollers".

Such a configuration allows holding of the label piece 200 in a drawable state even when the label piece 200 is relatively long.

When the label piece 200 is relatively short, the sets of output rollers 32*a* to 32*c* are driven independent of the conveyance roller 22 to convey the label piece 200 to a position at which the output rollers 32*c* and the spur rollers 33*c* hold the label piece 200. Such a configuration allows the label piece 200 to be held in a drawable state even when the label piece 200 is relatively short.

In some embodiments, when the label piece 200 is relatively short, label pieces 200 having been cut by a cutter unit 31 are configured to be held at positions downstream from the cutter unit 31 in a feed direction of the label pieces 200.

For example, in the configuration of FIG. 9, a first label piece is held between the output rollers 32*c* and the spur rollers 33*c*, a second label piece is held between the output rollers 32*b* and the spur rollers 33*b*, and a third label piece is held between the output rollers 32*a* and the spur rollers 33*a*. After the sensor 34 detects that the first label piece has been drawn out from between the output rollers 32*c* and the spur rollers 33*c*, the second label piece and the third label piece are fed in turn. Then, a fourth label piece is formed by driving the cutter unit 31 and is held between the output rollers 32*a* and the spur rollers 33*a*.

Such a configuration allows effective printing and delivery of short label pieces even in a structure in which the plurality of sets of output rollers 2*a* to 32*c* is provided to deal with a long label piece.

Next, a third exemplary embodiment of this disclosure is described with reference to FIG. 10.

Figure 10:
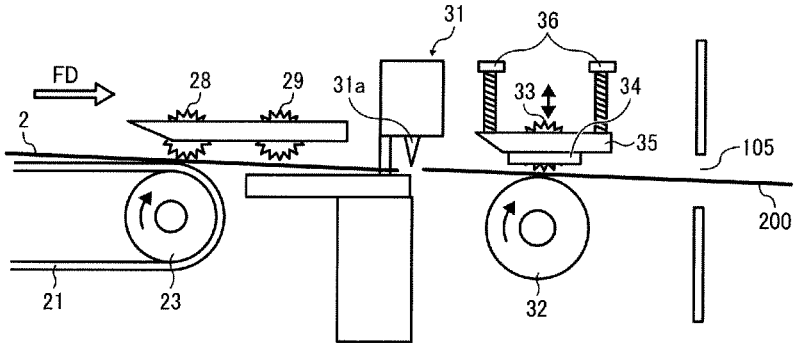
FIG. 10 is a side view of an output unit according to a third exemplary embodiment of this disclosure.

FIG. 10 is a side view of an output unit of an image forming apparatus according to the third exemplary embodiment of this disclosure.

In this exemplary embodiment, the output unit includes adjusting means (in this exemplary embodiment, adjuster 36) to adjust a height of a roller holder 35 holding spur rollers 33.

Such a configuration allows adjustment of a holding force for holding a label piece 200 by adjusting the height of the spur rollers 33 with the adjuster 36.

Until a print medium 2 is conveyed to the output rollers 32, the spur rollers 33 are retracted from the output rollers 32. When the print medium 2 reaches the output rollers 32, the spur rollers 33 are moved down to hold the print medium 2. With the print medium 2 held between the output rollers 32 and the spur rollers 33, the cutter unit 31 cuts the print medium 2 to form a label piece 200.

In other words, because of the tackiness (adhesion) of an adhesive face 2*b* of the print medium 2, the print medium 2 may not enter between rotors, such as rollers and spur rollers, thus causing a conveyance jam. Hence, on the entry of the print medium 2, the spur rollers 33 are moved away from the output rollers 32. After the spur rollers 33 are pressed against the output rollers 32 via the print medium 2, the print medium 2 is cut by the cutter unit 3*l* to form a print medium piece (label piece) 200. Then, the label piece 200 having been cut from the print medium 2 is held between the spur rollers 33 and the output rollers 32, thus preventing occurrence of a conveyance jam.

Next, a fourth exemplary embodiment of this disclosure is described with reference to FIG. 11.

Figure 11:
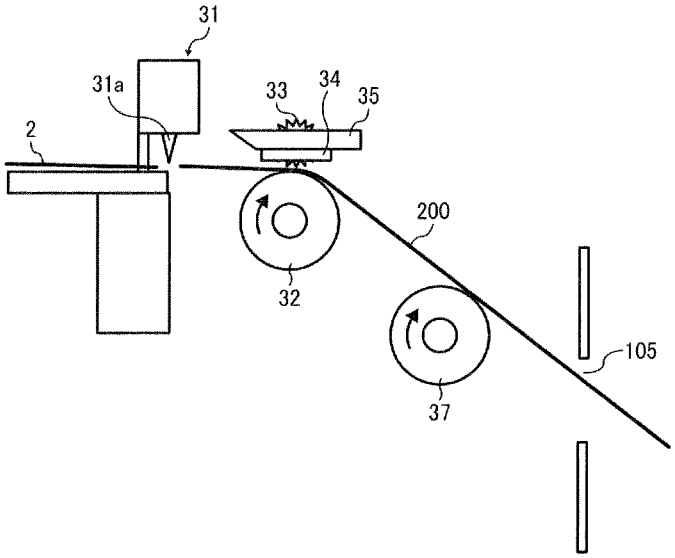
FIG. 11 is a side view of an output unit according to a fourth exemplary embodiment of this disclosure.

FIG. 11 is a side view of an output unit of an image forming apparatus according to the fourth exemplary embodiment of this disclosure.

A configuration of this exemplary embodiment differs from the configuration of the above-described first exemplary embodiment in that a rotary support roller 37 serving as a support member to support a label piece 200 is disposed at a position downward from and lower than the output rollers 32.

A surface of the support roller 37 is non-adhesive processed so that the adhesive face 2*b* of the label piece 200 does not adhere to the surface of the support roller 37. Alternatively, in some embodiments, the surface of the support roller 37 is made of a material that prevents the adhesive face 2*b* of the label piece 200 from adhering to the surface of the support roller 37.

For this exemplary embodiment, the support roller 37 is freely rotatable and rotated by movement of the label piece 200 without receiving transmission of the rotation driving force.

Such a configuration allows stable holding and standby of the label piece 200 even when the distance from the output rollers 32 to the output port 105 is relatively long, in other words, the label piece 200 is relatively long.

For example, the configuration of FIG. 9 employing, e.g., the spur rollers 33 and the roller holder 35 may increase the cost of components. In addition, since multiple output rollers 32 are arranged in parallel across a distance compatible with the length of the label piece 200, the image forming apparatus is likely to have a relatively large size.

However, if the lengths of label pieces 200 to be used are approximately constant, the arrangement of the support roller 37 at a position diagonally downward from the output rollers 32 as illustrated in FIG. 11 allows a reduction in the cost of components. In addition, supporting the label piece 200 diagonally downward allows a reduced apparatus size as compared to supporting the label piece 200 horizontally.

Next, a fifth exemplary embodiment of this disclosure is described with reference to FIG. 12.

Figure 12:
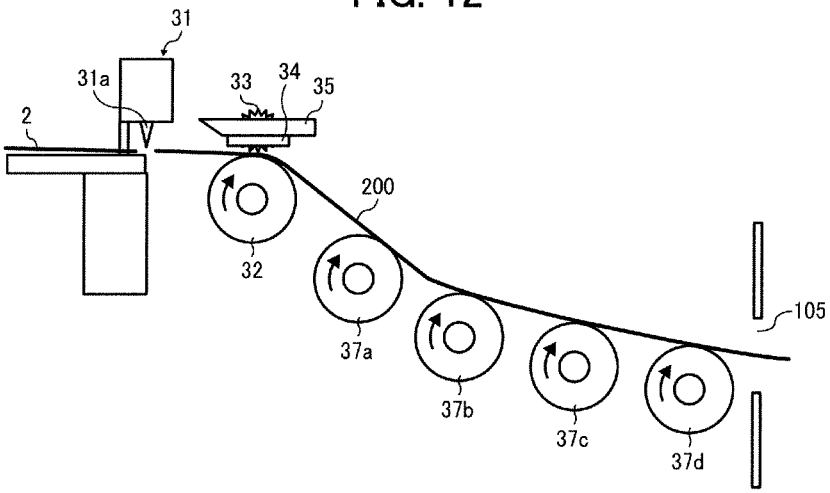
FIG. 12 is a side view of an output unit according to a fifth exemplary embodiment of this disclosure.

FIG. 12 is a side view of an output unit of an image forming apparatus according to the fifth exemplary embodiment of this disclosure.

A configuration of this exemplary embodiment differs from the configuration of the above-described first exemplary embodiment in that multiple sets of rotary support rollers (in this exemplary embodiment, four sets of rotary support rollers 37*a* to 37*d*) serving as support members to support a label piece 200 are disposed at positions downward from and lower than the output roller 32.

The sets of support rollers 37*a* to 37*d* are arranged in turn in a direction diagonally downward along a feed direction of the label piece 200.

Such a configuration can give effects equivalent to those of the above-described fourth exemplary embodiment and minimize the conveyance load in outputting the label piece 200.

Next, a sixth exemplary embodiment of this disclosure is described with reference to FIG. 13.

Figure 13:
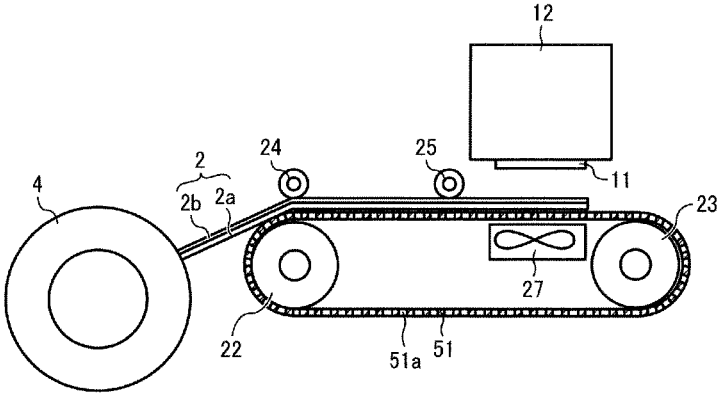
FIG. 13 is a side view of an output unit according to a sixth exemplary embodiment of this disclosure.

FIG. 13 is a side view of an image forming apparatus according to the sixth exemplary embodiment of this disclosure.

For this exemplary embodiment, a configuration of FIG. 13 is employed instead of the configuration of FIG. 3A in the first exemplary embodiment, and an image forming unit 102 forms an image on an adhesive face 2*a* of a print medium 2.

In such a case, the print medium 2 is sucked and adhered onto the conveyance belt 51 having suction holes 51, and with the print medium 2 adhered on the conveyance belt 51, the print medium 2 is conveyed. As with the configuration of FIG. 4, even the print medium 2 thus conveyed is held between output rollers 32 and spur rollers 33 for standby. In such a case, since an adhesive face 2*b* of the print medium 2 is faced up, the output rollers 32 and the spur rollers 33 are disposed at positions opposite to the positions of the output rollers 32 and the spur rollers 33 in FIG. 4.

As described above, conveying of the print medium 2 having an adhesive face with the conveyance belt 51 allows stable conveyance of the print medium 2.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an apparatus body including an output port;

a print medium installed in the apparatus body, the print medium having an adhesive face with no separation sheet mounted on the adhesive face;

a conveyance unit disposed in the apparatus body to convey the print medium;

an image forming unit disposed in the apparatus body to form an image on the print medium conveyed by the conveyance unit;

a cutter unit disposed in the apparatus body to cut the print medium having the image formed thereon into a print medium piece of a desired length;

a holding unit disposed downstream from the cutter unit in a conveyance direction in which the print medium is conveyed, the holding unit holds the print medium piece in a state in which at least a downstream leading end of the print medium piece in a feed direction in which the print medium piece is fed from the cutter unit to the holding unit is projected from the output port of the apparatus body and the print medium piece is drawable from outside of the apparatus body, the holding unit having a surface separatable from an adhesive face of the print medium piece to hold the adhesive face of the print medium piece;

a sensor to detect presence or absence of the print medium piece held by the holding unit; and a controller to, after the sensor detects that the print medium piece held by the holding unit is drawn out, control the conveyance unit to convey the print medium to the holding unit and control the holding unit to hold the print medium.

2. The image forming apparatus of claim 1, wherein, after the print medium piece is drawn out, the controller controls the cutter unit to cut the print medium and the conveyance unit to convey the print medium piece to the holding unit.

3. The image forming apparatus of claim 1, wherein, after the print medium piece is drawn out, the controller controls the image forming unit to start image formation on the print medium.

4. The image forming apparatus of claim 1, wherein, before the print medium piece is drawn out, the controller controls the image forming unit to perform subsequent image formation on the print medium.

5. The image forming apparatus of claim 1, wherein the holding unit is also an output unit to feed the print medium piece cut by the cutter unit toward the output port and hold the print medium piece.

6. The image forming apparatus of claim 5, wherein the output unit comprises at least one rotor pair, each including two rotors disposed opposite to each other in a vertical direction to sandwich the print medium piece conveyed to the output unit between the two rotors, one of the two rotors has multiple rollers divided in an axial direction thereof, the other of the two rotors has multiple rollers divided in an axial direction thereof, and the multiple rollers of the one of the two rotors are disposed at positions not opposing the multiple rollers of the other of the two rotors.

7. The image forming apparatus of claim 5, wherein the output unit has a plurality of rotors disposed in turn in a feed direction in which the output unit feeds the print medium piece.

8. The image forming apparatus of claim 5, further comprising at least one support member to support the print medium piece fed by the output unit, wherein the at least one support member is disposed downstream from the output unit In a feed direction in which the output unit feeds the print medium piece.

9. The image forming apparatus of claim 8, wherein the at least one support member is a rotor.

10. An image forming apparatus comprising:

an apparatus body;

a print medium installed in the apparatus body, the print medium having an adhesive face with no separation sheet mounted on the adhesive face;

a conveyance unit disposed in the apparatus body to convey the print medium;

an image forming unit disposed in the apparatus body to form an image on the print medium conveyed by the conveyance unit;

a cutter unit disposed in the apparatus body to cut the print medium having the image formed thereon into a print medium piece of a desired length;

a holding unit disposed downstream from the cutter unit in a conveyance direction in which the print medium is conveyed, the holding unit configured to hold the print medium piece in a state in which the print medium piece is drawable from outside of the apparatus body, the holding unit having a surface separatable from an adhesive face of the print medium piece to hold the adhesive face of the print medium piece;

a sensor to detect presence or absence of the print medium piece held by the holding unit;

a controller to, after the sensor detects that the print medium piece held by the holding unit is drawn out, control the conveyance unit to convey the print medium to the holding unit and control the holding unit to hold the print medium;

an output port through which the print medium piece is drawn out from the apparatus body, wherein the holding unit is also an output unit to feed the print medium piece cut by the cutter unit toward the output port and hold the print medium piece; and a plurality of support members to support the print medium piece fed by the output unit, wherein the plurality of support members is disposed in turn diagonally downward and downstream from the output unit in a feed direction in which the output unit feeds the print medium piece.

11. An image forming apparatus, comprising:

an apparatus body including an output port;

a print medium installed in the apparatus body, the print medium having an adhesive face with no separation sheet mounted on the adhesive face;

conveyance means for conveying the print medium;

image forming means for forming an image on the print medium conveyed by the conveyance means;

cutting means for cutting the print medium having the image formed thereon into a print medium piece of a desired length;

holding means for holding the print medium piece in a state in which at least a downstream leading end of the print medium piece in a feed direction in which the print medium piece is fed from the cutting means to the holding means is projected from the output port of the apparatus body the print medium piece is drawable from outside of the apparatus body;

detection means for detecting presence or absence of the print medium piece held by the holding means; and control means for, after the detection means detects that the print medium piece held by the holding means is drawn out, controlling the conveyance means to convey the print medium to the holding means and control the holding means to hold the print medium.

12. The image forming apparatus of claim 11, wherein the holding means is configured to feed the print medium piece cut by the cutting means in the feed direction toward the output port and hold the print medium piece in the state in which the print medium piece is drawable from the outside of the apparatus body.

13. The image forming apparatus of claim 12, further comprising a plurality of support members to support the print medium piece fed by the holding means, wherein the plurality of support members is disposed in turn diagonally downward and downstream from the holding means in the feed direction in which the holding means feeds the print medium piece.

14. The image forming apparatus of claim 5, further comprising a plurality of support members to support the print medium piece fed by the output unit in the feed direction, wherein the plurality of support members is disposed in turn diagonally downward and downstream from the output unit in the feed direction in which the output unit feeds the print medium piece.

* * * * *